US012066266B2

(12) United States Patent
Larson et al.

(10) Patent No.: US 12,066,266 B2
(45) Date of Patent: Aug. 20, 2024

(54) PRECISION BORE GUIDE AND TOOL

(71) Applicants: Colter Larson, Cody, WY (US); Tyler Sims, McFadden, WY (US)

(72) Inventors: Colter Larson, Cody, WY (US); Tyler Sims, McFadden, WY (US)

( * ) Notice: Subject to any disclaimer, the term of this patent is extended or adjusted under 35 U.S.C. 154(b) by 278 days.

(21) Appl. No.: 17/323,964

(22) Filed: May 18, 2021

(65) Prior Publication Data

US 2022/0373287 A1 Nov. 24, 2022

(51) Int. Cl.
*F41A 29/02* (2006.01)

(52) U.S. Cl.
CPC ..... *F41A 29/02* (2013.01)

(58) Field of Classification Search
CPC ..... F41A 29/02; F41A 35/00; F41A 29/00; B08B 9/00; B08B 2209/04; B08B 9/0436; B25H 3/021; B65D 50/04; F41C 27/00; F41C 33/00
USPC ..... 42/195; 102/442
See application file for complete search history.

(56) References Cited

U.S. PATENT DOCUMENTS 4,866,871 A * 9/1989 Rivers ..... F41A 29/02 42/95
5,628,136 A * 5/1997 Wickser, Jr. ..... F41A 29/02 42/95
5,836,099 A * 11/1998 Pace ..... F41A 29/02 42/95
5,898,972 A * 5/1999 Rademacher ..... H04R 25/00 15/341
5,987,683 A * 11/1999 Leiman ..... F41A 31/02 15/104.19
6,276,018 B1 * 8/2001 Leiman ..... F41A 29/02 15/104.095
8,539,706 B1 * 9/2013 Vieweg ..... F41A 3/82 42/1.06
2006/0277811 A1 * 12/2006 Peterson ..... F41A 29/02 42/95
2010/0199999 A1 * 8/2010 Vazales ..... A61B 90/70 128/207.14
2010/0325933 A1 * 12/2010 Huang ..... F41C 27/00 42/90
2012/0167425 A1 * 7/2012 Buschow ..... F41A 3/86 42/14
2013/0160227 A1 * 6/2013 Rutkowski ..... B08B 9/0436 15/104.33
2016/0202015 A1 * 7/2016 Poehlman ..... F41A 29/02 42/90
2018/0257118 A1 * 9/2018 Pineda ..... F41A 29/02
2019/0107357 A1 * 4/2019 McDonald ..... F41A 29/02

* cited by examiner

*Primary Examiner* — Michael D David
(74) *Attorney, Agent, or Firm* — Peter J Timbers

(57) ABSTRACT

A precision bore guide and precision bore guide tool is presented that together comprise a main tube, a front stop, a movable stop, and a hollowed-out rifle round, a spring and a guide bolt knob which is inserted into the receiver of a firearm and a rod is inserted into the guide through the main tube and into the hollowed-out round and through the barrel of a rifle firearm.

18 Claims, 8 Drawing Sheets

PRECISION BORE GUIDE AND TOOL

FIELD OF THE INVENTION

The present invention relates to providing a bore guiding tool that allows for more effective and safer cleaning of the action, chamber, shoulder, neck and throat of a firearm.

BACKGROUND OF THE INVENTION

Cleaning and safely maintaining firearms, especially rifles is of great importance because these two activities contribute to a well-functioning firearm that maintains value and is accurate and precise whether a shooter is target practicing or in the field. Contemporary bore guides that are on the market today are designed as a semi universal fit in that they are designed for different ranges of calibers instead of uniquely fitting one caliber of a firearm. With this universal fit design, there exists a void at the end of the chamber and throat during rifle cleaning. Unfortunately, the void provides ample opportunity for bore cleaning debris to occupy the chamber of the rifle. The debris damages the firearm and decreases its accuracy and precision during firearm use. Further, the universal fit allows the bore guide to move, which risks damaging the throat and lands areas of the rifle, where the bullet must be accurately and precisely lodged and where the bullet actually contacts the rifling. Thus, there is a long felt need to provide a mechanism to protect the action, chamber, shoulder, neck, and throat, as well as the bore of a rifle during cleaning.

SUMMARY OF THE INVENTION

Accordingly, it is an object of embodiments of the present invention to provide for a rifle precision bore guide tool. Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims. To achieve the foregoing and other objects, and in accordance with the purposes of the present invention, as embodied and broadly described herein, the invention comprises precision bore guide comprising a main tube, a front stop, a movable stop, and a spring, and the main tube has an inner circumference, outer circumference, a proximal end and a distal end, and the front stop and the movable stop are connected to the main tube, and the front stop is disposed between the proximal end and the moveable stop, and the spring is disposed around the outer circumference of the main tube, and the spring is disposed between the front stop and the movable stop.

In another embodiment, the instant invention comprises a precision bore guide tool comprising a main tube, a front stop, a movable stop, and a hollowed-out rifle round and the hollowed out rifle round has a rim end, a casing body, a shoulder and a neck, the rim end connects to the main tube and the casing body, the casing body is disposed between the rim end and the shoulder, the shoulder disposed between the neck and the casing body and the main tube has an inner circumference, outer circumference, a proximal end and a distal end, the proximal end connects to the hollowed-out rifle round; the front stop and the movable stop are connected to the main tube; and the front stop is disposed between the proximal end and the moveable stop.

Benefits and advantages of the present precision bore guide and precision bore guide tool invention include, but are not limited to, providing a means to effectively and safely clean the action, chamber, shoulder, neck, throat and bore of a firearm. The invention solves the problems associated with imprecise bore guides that allow for cleaning byproduct debris that enters into the action, chamber, shoulder, neck, and throat, as well as the bore of a rifle during cleaning. The instant invention provides a custom fit per caliber that holds tight to the rifle chamber and stays true with the bore.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION AND DRAWINGS

Figure 1:
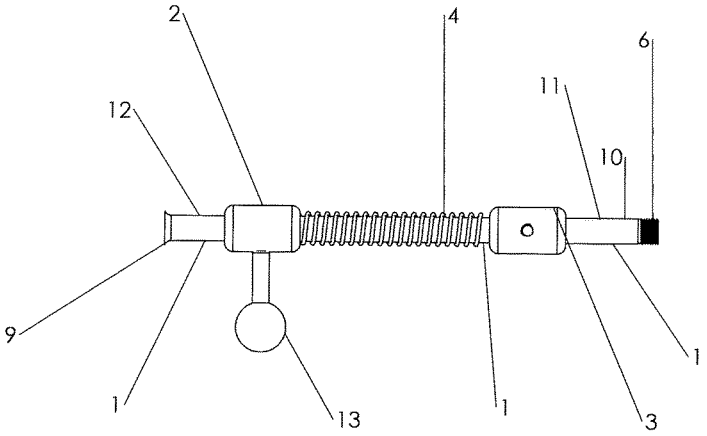
FIG. 1 illustrates a side planar view of one embodiment of the invention.

Reference will now be made in detail to embodiments of the invention, examples of which are illustrated in the accompanying drawings. Throughout the following detailed description, the same reference characters refer to the same or similar elements in all Figures. In this detailed description, reference is to a few embodiments of the instant invention, as illustrated in the accompanying and above-referenced drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

FIG. 1 depicts one embodiment of the instant invention, namely, a precision bore guide 10 comprising a main tube 1, a front stop 3, a movable stop 2; the main tube 1 has an inner circumference, an outer circumference, a proximal end 11 and a distal end 12. The proximal end 11 connects to the hollowed-out rifle round (not pictured). The front stop 3 and the movable stop 2 are connected to the main tube 1. The front stop 3 is disposed between the proximal end 11 and the moveable stop 2.

In some embodiments, as the one shown in FIG. 1, precision bore guide 10 has a spring 4 is disposed around the main tube 1 and the spring 4 is disposed between the front stop 3 and the movable stop 2. FIG. 1 also depicts a guide bolt knob 13 connected to the movable stop 2. In the embodiment depicted in FIG. 1, the movable stop 2 has an inner circumference that is larger than the outer circumference of the main tube 1. The main tube 1 further comprises a flared end 9 at the distal end 12 of the main tube 1, the flared end 9 having circumference that is larger than the inner circumference of the moveable stop 2.

FIG. 1 depicts another embodiment of the instant invention wherein the front stop 3 disposed at the proximal end 11 of the main tube 1 comprises a tube having an inner circumference that is larger than the outer circumference of the main tube 1. FIG. 1 also depicts one embodiment of the instant invention wherein the proximal end further comprises a threaded outer surface.

Figure 2:
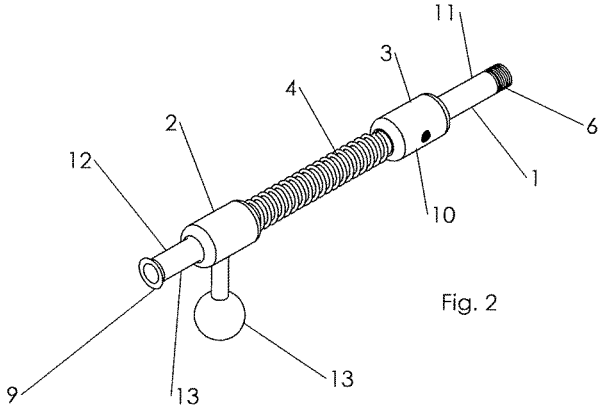
FIG. 2 illustrates a top and side perspective view of another embodiment of the invention.

FIG. 2 depicts one embodiment of the instant invention, wherein the precision bore guide 10 illustrating the main tube 1, the front stop 3, the movable stop 2, the proximal end 11 and the distal end 12 of the main tube 1. FIG. 2 further depicts the spring 4, the guide bolt knob 13 connected movable stop 13, the flared end 9 at the distal end 12 of the main tube 1, and the proximal end 11 having a threaded outer surface. The outer circumference of said flared end 9 is larger than the inner circumference of said movable stop 2.

Figure 3:
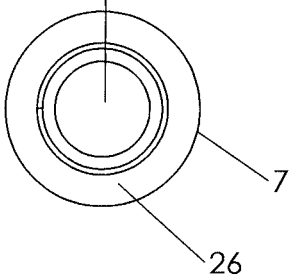
FIG. 3 illustrates an end view of one embodiment of the instant invention.

FIG. 3 depicts the rim end 26 of the hollowed-out round 7 having a hole 22 approximately down the middle of the hollowed-out round 7. The hole 22 is surrounded by the rim end 26 of the hollowed-out round 7.

Figure 4:
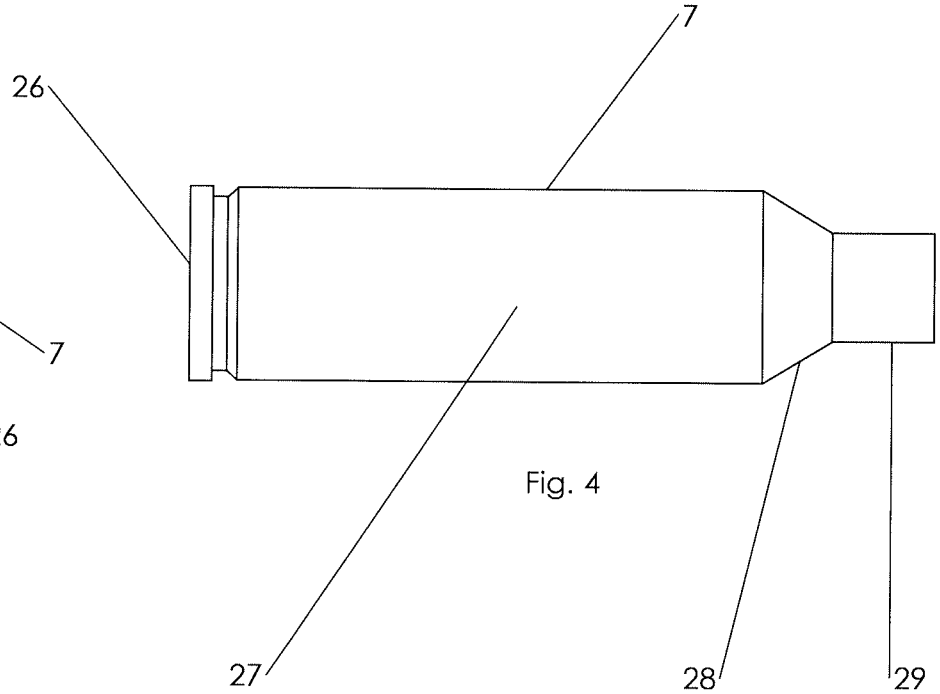
FIG. 4 illustrates a side planar view of one embodiment of the instant invention.

FIG. 4 depicts the hollowed-out round 7 having a casing body 27, a shoulder 28 and a neck 29. The rim end connects the main tube (Not depicted) to the casing body 27 of the hollowed-out round 7. The casing body 27 is disposed between the rim end 26 and the shoulder 28. The shoulder 28 is disposed between the neck 29 and the casing body 27.

Figure 5:
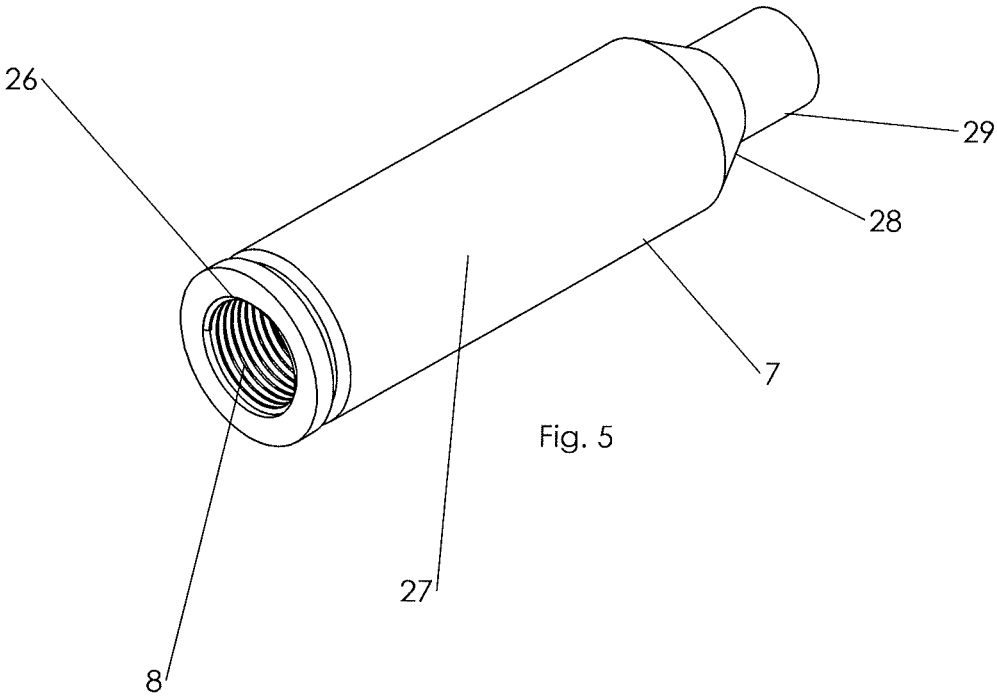
FIG. 5 illustrates a side and top rear perspective view of one embodiment of the instant invention.

FIG. 5 depicts the hollowed-out round 7, the casing body 27, the shoulder 28, the neck 29 and the threaded inner surface of the rim end.

Figure 6:
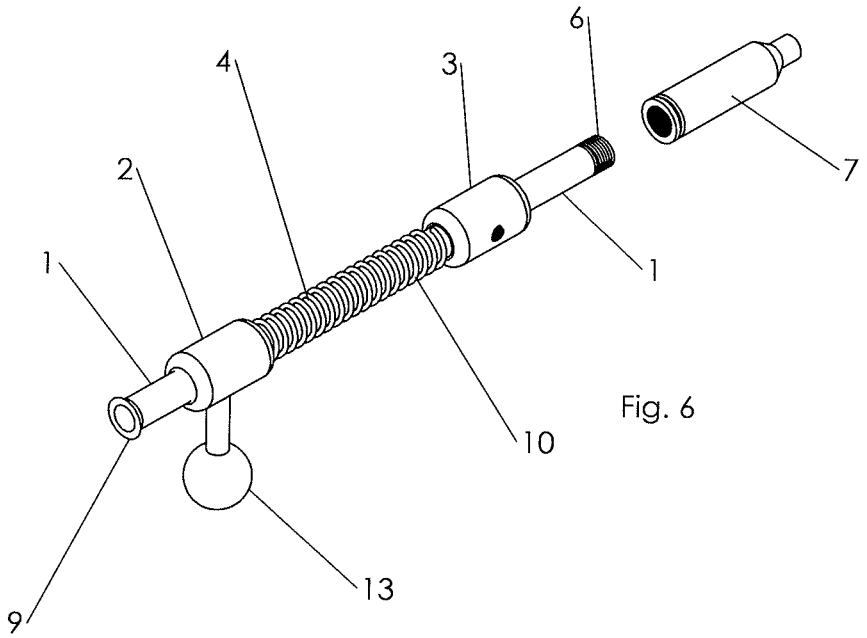
FIG. 6 illustrates a side and top perspective view of one embodiment of the instant invention depicting of one how the precision bore guide and hollowed-out round prior to connection made between the two elements.

FIG. 6 depicts the hollowed-out round 7 and the precision bore guide 10 prior to connection.

Figure 7:
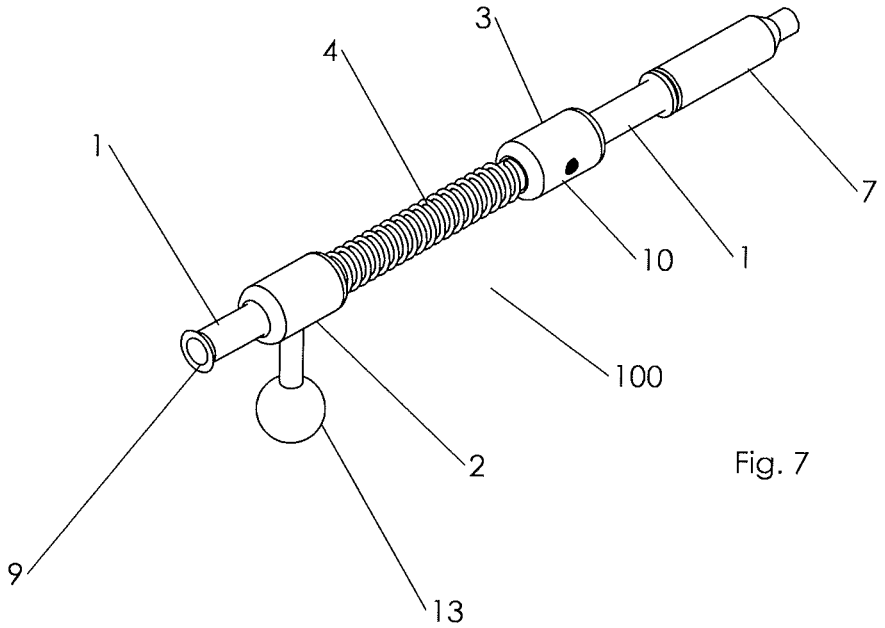
FIG. 7 illustrates a side and top perspective view of one embodiment of the instant invention depicting of one how the precision bore guide and hollowed-out round as connection is made between the two elements to form the precision bore guide tool.

FIG. 7 depicts the hollowed-out round 7 connected to the precision bore guide 10 to form the precision bore guide tool 100

Figure 8:
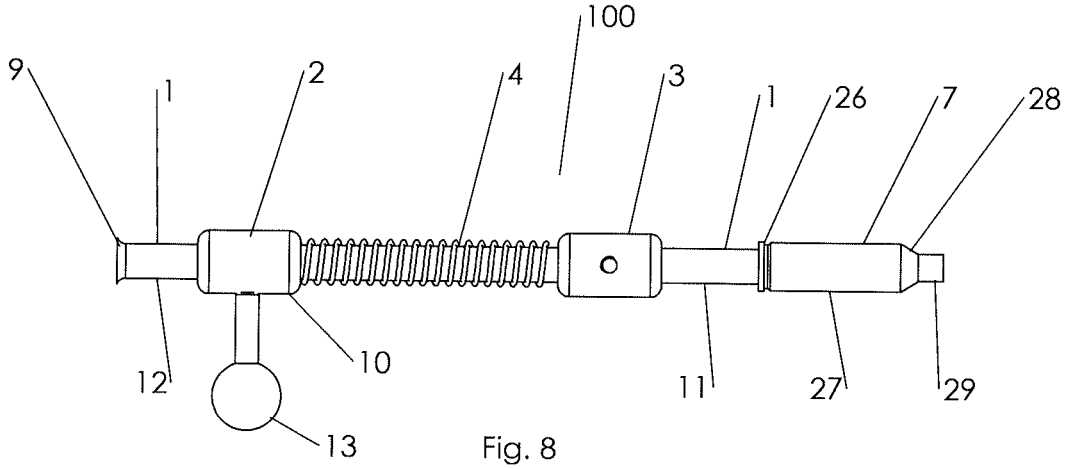
FIG. 8 illustrates a side planar view of one embodiment of the instant invention depicting one embodiment of the precision bore guide tool invention.
Figure 9:
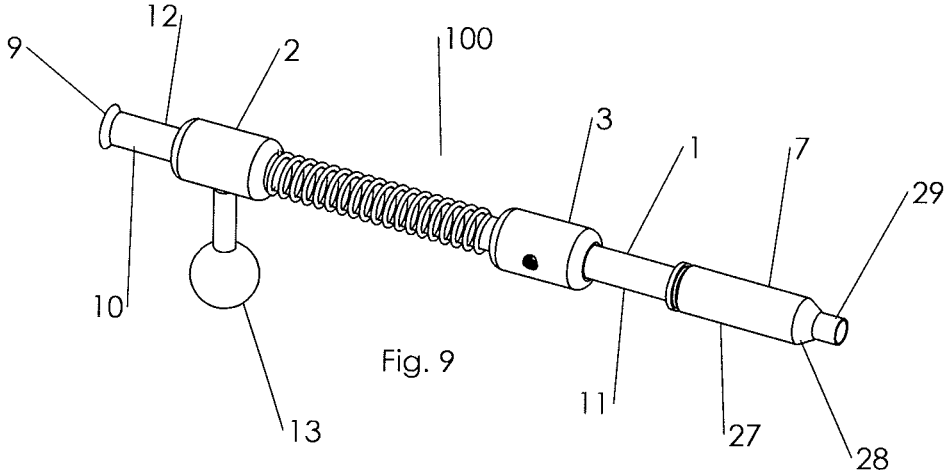
FIG. 9 illustrates an end planar view of the one embodiment of the instant precision bore guide tool invention.

Similarly, FIG. 8 and FIG. 9 also depict the connection of the precision bore guide 10 contacting the hollowed-out round 7 to form the precision bore guide tool, which is ready for ready for insertion into the action and chamber portion of a rifle.

Figure 10:
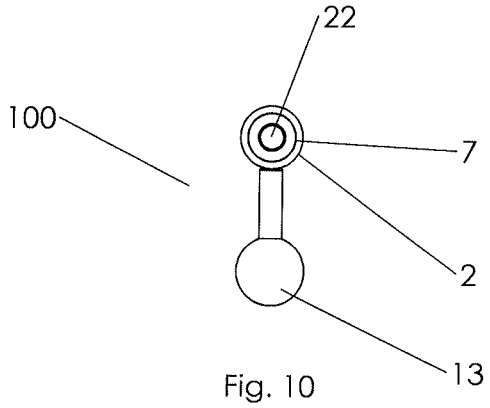
FIG. 10 illustrates a front-end view of one embodiment of the instant invention depicting connection that is made between the precision bore guide tool and the hollowed-out round.

FIG. 10 depicts an end on view of the hollowed out round connected to the precision bore guide tool and the guide bolt knob 13 connected movable stop of the precision bore guide tool.

Figure 11:
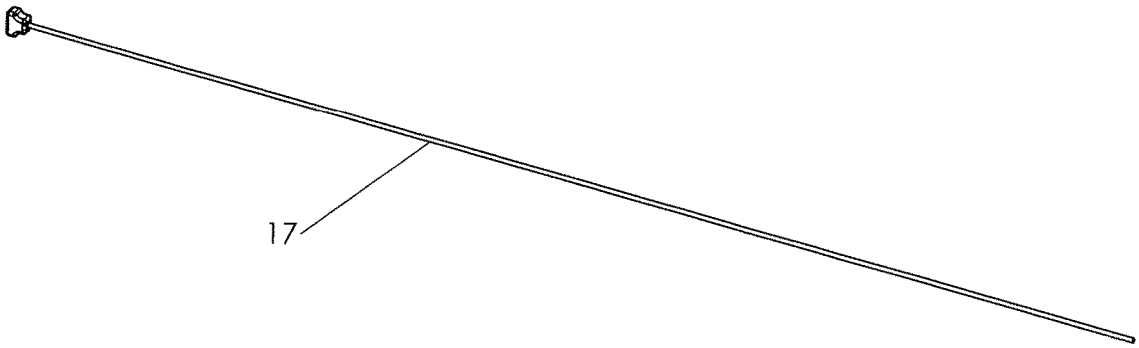
FIG. 11 illustrates a top side perspective view of a rod and the precision bore guide tool.
Figure 11:
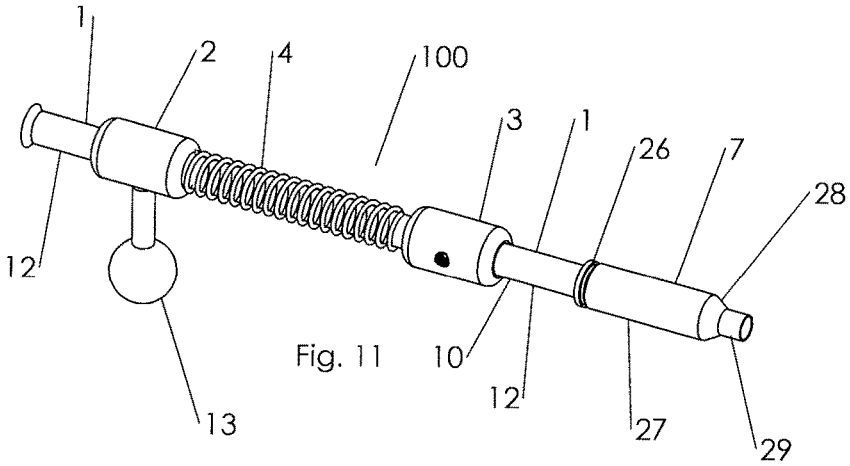

FIG. 11 depicts a rod 17 next to the precision bore guide tool 100 having the hollowed-out round 7 attached to the precision bore guide 10. The rod having an outer circumference.

Figure 12:
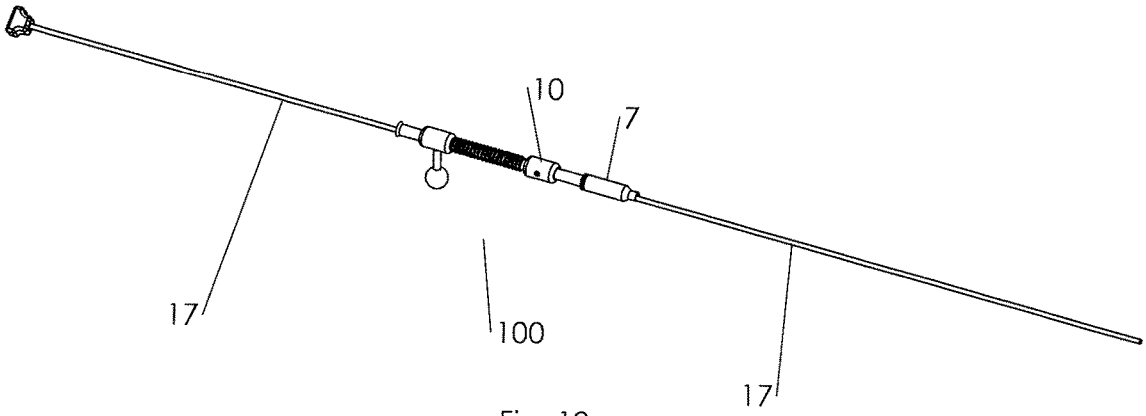
FIG. 12 illustrates a top side perspective view of the rod inserted into the precision bore guide tool.

FIG. 12 depicts the rod 17 inserted into and through the precision bore guide tool 100. The guide tool having an inner circumference that is greater than the outer circumference of the rod 17.

Figure 13:
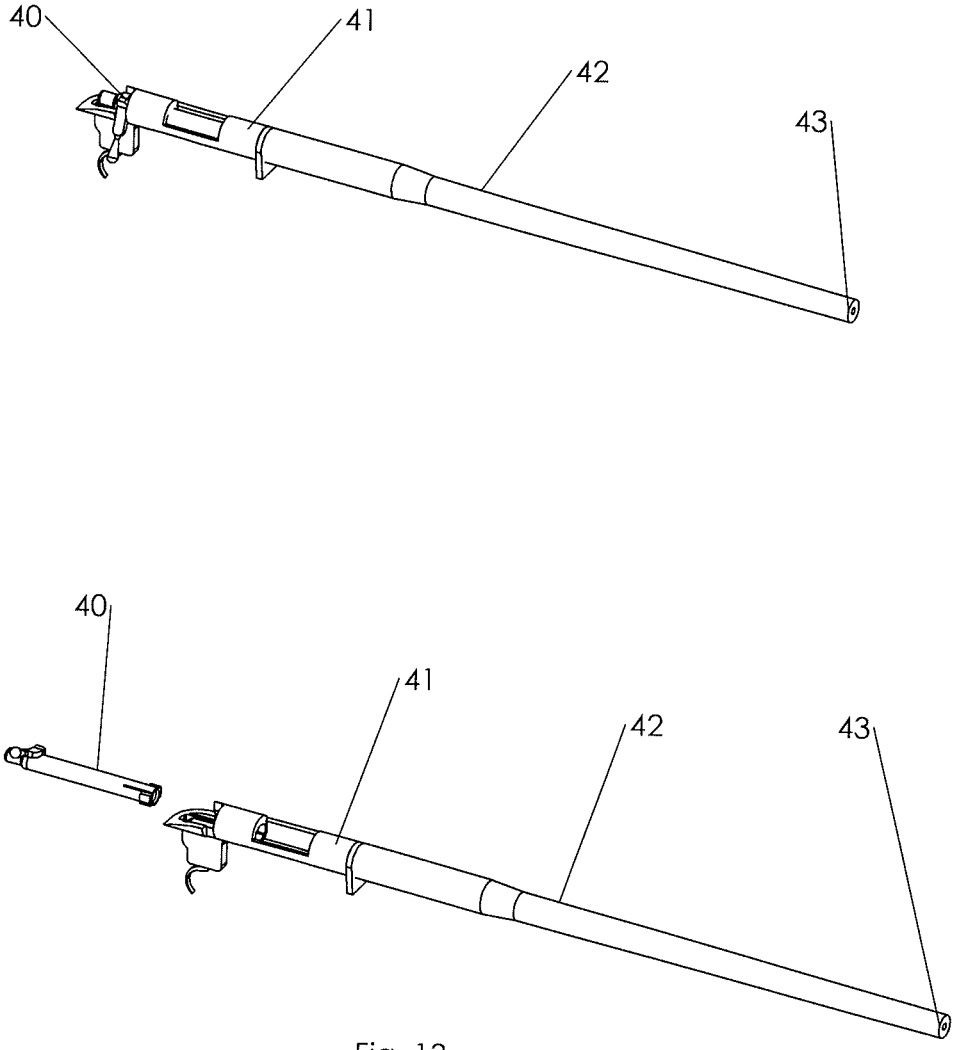
FIG. 13 illustrates removal of the bolt from the action of the rifle.

FIG. 13 depicts how the rifle is prepared for the precision bore guide tool to be used. The top drawing depicts the rifle bolt 40 in the receiver portion 41 of the rifle. The rifle has a barrel 42 and a muzzle 43 where a rifle projectile exits the rifle. The bottom drawing depicts the bolt 40 removed from the receiver portion 41 of the rifle.

Figure 14:
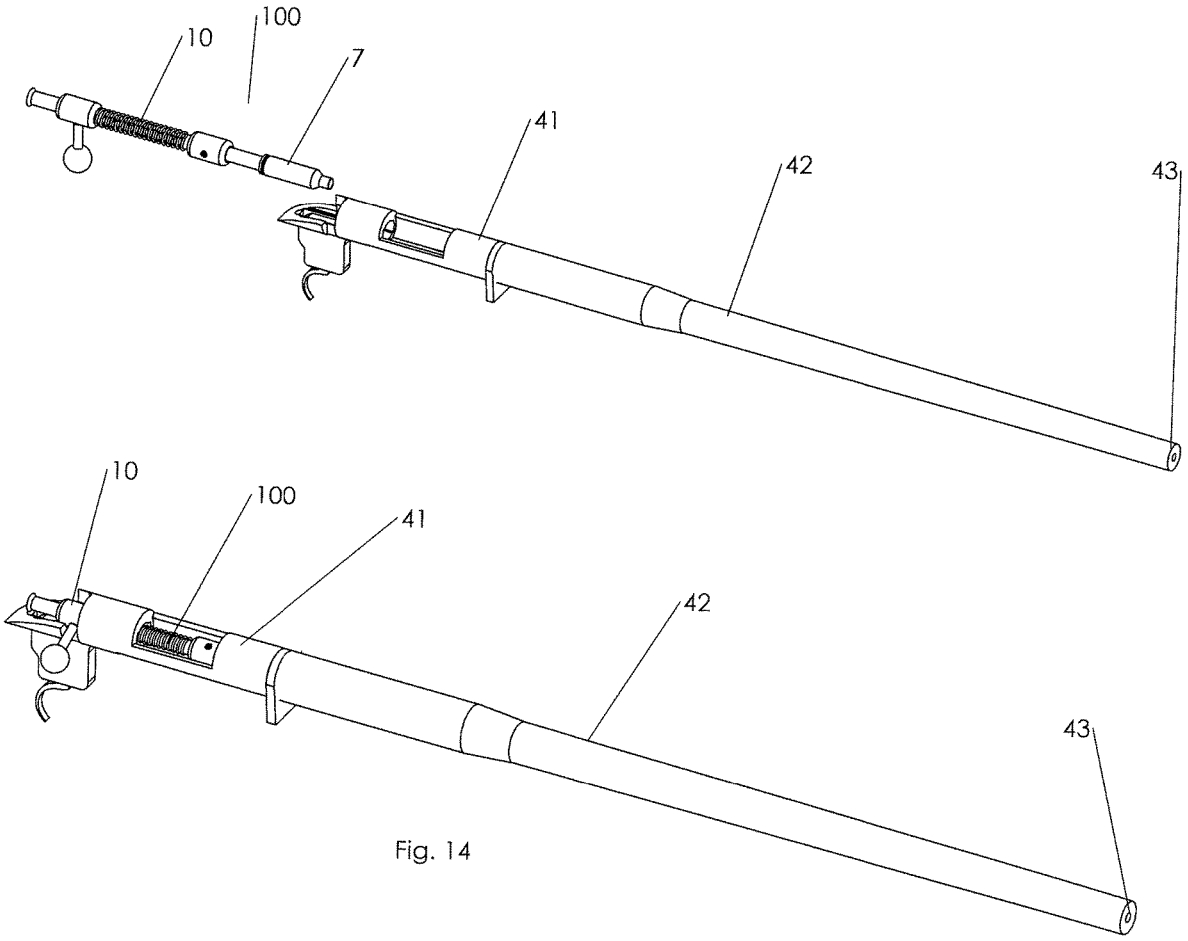
FIG. 14 illustrates insertion of one embodiment of the instant invention into the action of the rifle.

FIG. 14 continues to depict how the precision bore guide tool is used and, similar to FIG. 13, also has two drawings. The top drawing depicts the precision bore guide tool 100 and hollowed-out round prior to insertion into the receiver portion 41 of the rifle. The bottom drawing depicts the precision bore guide tool 100 inserted into the action portion 41 of the rifle.

Figure 15:
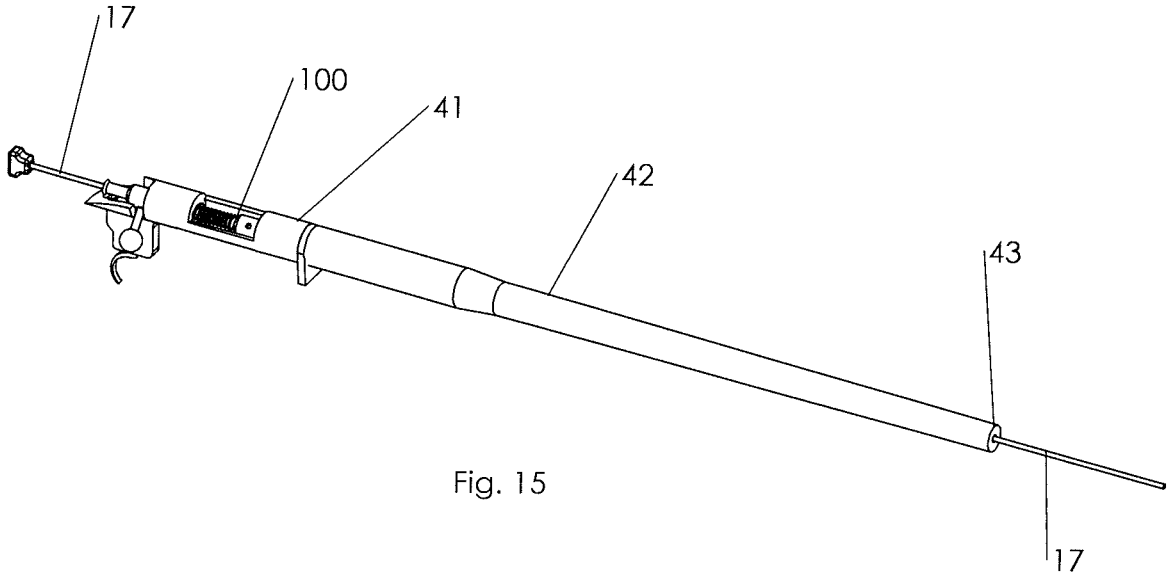
FIG. 15 illustrates insertion of the rod into the precision bore guide tool and into the rifle and extending out of the rifle.

FIG. 15 also continues to depict how the precision bore guide tool is used. In FIG. 15, the rod 17 inserted into the precision bore guide tool 100 inside the action portion, and the rifle bore portion of the rifle. The hollowed-out round matches the same dimensions as the rifle chamber and the rod 17 extends through the hollowed-out round into the bore and through the muzzle 43 of the rifle barrel. This configuration prevents any of the dirt, grime, and residue from the rifle barrel from being deposited into the receiver, action, chamber, shoulder, neck and throat of the rifle during rifle cleaning.

The hollowed-out round matches the type of rifle being cleaned to maximize the cleaning efficiency of the precision bore guide tool.

The rifle round of the hollowed-out rifle round is selected from the group of rifle rounds consisting of .17 PMC/Aguila, .17 Hornady Mach 2, 17 Hornady Magnum Rimfire, 17 Winchester Super Magnum, 5 mm Remington Rimfire Magnum, .22 BB Cap, .22 CB Cap, .22 Short, .22 Long, .22 Long Rifle, .22 Extra Long, .22 Remington Automatic, .22 Winchester Automatic, .22 Winchester Rimfire, .22 Winchester Magnum Rimfire, .25 Stevens, .25 Stevens Short, .32 rimfire, .38 rimfire, 10.4×38 mm Swiss Rimfire, .44 Henry, .46 rimfire, .56-46 Spencer, .56-50 Spencer, .56-52 Spencer, .56-56 Spencer, .14-222, .17-223, .17 Ackley Bee, .17 CCM, .17 Hornet, .17 Mach IV, .17 PMC/Aguila, .17 Remington, .17 Remington Fireball, .19-223, .19 Badger, .19 Calhoon Hornet, .20 BR, .20 Tactical, .20 VarTarg, .204 Ruger, .22 Accelerator, .22 Hornet, .22 Cheetah, .218 Bee, .219 Donaldson Wasp, .219 Zipper, .303/22, .22 Savage Hi-Power, .22 BR Remington, .22 Cheetah, .22 Eargesplitten Loudenboomer, .22 PPC, .22 Spitfire, .22 WCF, .220 Russian, .220 Rook, .220 Swift, .221 Remington Fireball, .22 Nosier, .22-250 Remington, .222 Remington, .222 Remington Magnum, .222 Rimmed, .223 Remington, .223 Winchester Super Short Magnum, .224 Weatherby Magnum, .224 Valkyrie, .225 Winchester, .297/230 Morris, .240 Apex, .240 Weatherby Magnum, .242 Rimless Nitro Express, .243 Winchester, .243 Winchester Super Short Magnum, .244 H&H Magnum, .244 Remington, .246 Purdey, .303/25, .25 Remington, .25-45 Sharps, .25-21 Stevens, .25-25 Stevens, .25 Winchester Super Short Magnum, .250 Savage, .25-06 Remington, .25-20 Winchester, .25-35 Winchester, .25-45 Sharps, .297/250 Rook, .250-3000 Savage, .255 Jeffery Rook, .256 Gibbs Magnum, .256 Newton, .256 Winchester Magnum, .257 Roberts, .257 Weatherby Magnum, .26 Nosier, .260 Remington, .264 LBC-AR, .264 Winchester Magnum, .270 Weatherby Magnum, .270 Winchester, .270 Winchester Short Magnum, .275 H&H Magnum, .275 No 2 Magnum, .275 Rigby, .276 Enfield, .276 Pedersen, .277 FURY, .277 Wolverine, .28 Nosier, .280 British, .280 Ross, .280 Flanged, .280 Jeffery, .280 Remington. .280 Ross, .284 Winchester, .30-01, .30-03, .30 Carbine, .30-06 JDJ, .30-40 Krag, .30 Newton, .30 Nosier, .30 R Blaser, .30 Remington, .30 Remington AR, .30-06 Springfield, .303-06, .30 TC, .30-378 Weatherby Magnum, .30-30 Winchester, .300-221, .300 AAC Blackout, .300 H&H Magnum, .300 ICL Grizzly, .300 Lapua Magnum, .300 Norma Magnum, .300 Remington Short Action Ultra Magnum, .300 Remington Ultra Magnum, .300 Rook, .300 Ruger Compact Magnum, .300 Savage, .300 Sherwood, .300 Weatherby Magnum, .300 Whisper, .300 Winchester Magnum, .300 Winchester Short Magnum, .303 British, .303 Magnum, .303 Savage, .375/303 Westley Richards Accelerated Express, .307 Winchester, .308 Marlin Express, .308 Norma Magnum, .308 Winchester, .308×1.5" Barnes, .310 Cadet, .318 Westley Richards, .32 Remington, .32 Winchester Self-Loading, .32 Winchester Special, .32-20 Winchester, .32-40 Ballard, .32-40 Winchester, .325 Winchester Short Magnum, .327 Federal Magnum, .33 Winchester, .333 Jeffery, .338-06 A-Square, .338 Edge, .338 Federal, .338 Lapua Magnum, .33 Nosler, .338 Marlin express, .338 Norma Magnum, .338 Remington Ultra Magnum, .338 Ruger Compact Magnum, .338 Winchester Magnum, .338-378 Weatherby Magnum, .338 Whisper, .340 Weatherby Magnum, .348 Winchester, .35 Winchester Self-Loading, .35 Remington, .35 Whelen, .35 Winchester, .350 Legend, .400/350 Nitro Express, .351 Winchester Self-Loading, .350 Remington Magnum, .350 Rigby, .356 Winchester, .357 Magnum, .358 Norma Magnum, .358 Winchester, .400/360 Nitro Express, .360 No 2 Nitro Express, .360 No 5 Rook, .369 Nitro Express, .375 CheyTac, .375 Dakota, .375 Flanged Nitro Express, .375 H&H Magnum, .375 Remington Ultra Magnum, .375 Ruger, .375 SOCOM, .375 Weatherby Magnum, .375 Whelen, .375 Winchester, .376 Steyr, .378 Weatherby Magnum, .38-40 Winchester, .38-55 Winchester, .38-56 WCF, .380 Long, .40-65 Winchester, .450/400 Black Powder Express, .400 H&H Magnum, .450/400 Nitro Express, .400 Jeffery Nitro Express, .400 Purdey, .400 Whelen, .401 Winchester Self-Loading, .404 Jeffery, .405 Winchester, .408 CheyTac, .416 Barrett, .416 Remington Magnum, .416 Rigby, .416 Ruger, .416 Taylor, .416 Weatherby Magnum, .425 Westley Richards, .44 Henry, .44 Magnum, .44-40 Winchester, .444 Marlin, .45-70 Government, .45-90 Sharps, .45 Raptor, .450 Bushmaster, .577/450 Martini-Henry, .450 Black Powder Express, .500/450 Magnum Black Powder Express, .450 Marlin, .450 Nitro Express, .500/450 No 1 Black Powder Express, .450 No 2 Nitro Express, .454 Casull, .500/450 Nitro Express, .450 Rigby, .450 Watts Magnum, .458×2-inch American, .458 Express, .458 HAM'R, .458 Lott, .458 SOCOM, .458 Winchester Magnum, .460 Steyr, .460 Weatherby Magnum, .461 Gibbs, .465 H&H Magnum, .500/465 Nitro Express, .470 Nitro Express, .475 Nitro Express, .475 No 2 Nitro Express, .476 Nitro Express, .50 Alaskan, .50 Beowulf, .50 BMG, .50-70 Government, .50-90 Sharps, .50-110 Winchester, .50-140 Sharps, .500 A-Square, .500 Black Powder Express, .500 Jeffery, .500 Nitro Express, .577/500 Nitro Express, .577/500 No 2 Black Powder Express, .505 Gibbs, .510 DTC Europ, .510 Whisper, .55 Boys, 20/577 Alexander Henry, .577 Black Powder Express, .577 Nitro Express, .600/577 Rewa, .577 Snider, .577 Tyrannosaur, .585 Nyati, .600 Overkill, .600 Nitro Express, .700 Nitro Express, .950 JDJ, 4.5 mm mkr, 4.6×30 mm, 4.85×49 mm, 5 mm Craig, 5 mm/35 SMc, 5.45×39 mm, 5.56×30 mm MINSAS, 5.56×45 mm NATO, 5.6×50 mm Magnum, 5.6×57 mm, 5.6×57 mmR, 5.6×61 mm VHSE, 5.7×28 mm, 5.8×42 mm, 6×45 mm, 6 mm AR, 6 mm ARC, 6 mm BR Remington, 6 mm Creedmoor, 6 mm Lee Navy, 6 mm Musgrave, 6 mm PPC, 6 mm Remington, 6 mm TCU, 6 mm XC, 6.5-06, 6.5-06 A-Square, 6.5 Creedmoor, 6.5 mm Grendel, 6.5-284 Norma, 6.5 mm Remington Magnum, 6.5 mm TCU, 6.5×47 mm Lapua, 6.5×50 mm Arisaka, 6.5×52 mm Mannlicher-Carcano, 6.5×53 mmR, 6.5×54 mm Mannlicher-Schönauer, 6.5×55 mm Swedish, 6.5×57 mm Mauser, 6.5×58 mm Vergueiro, 6.5×68 mm, 6.5-300 Weatherby Magnum, 6.8 mm Remington SPC, 7×64 mm Brenneke, 7 mm BR Remington, 7×54 mm Finnish, 7×54 mm Fournier, 7×57 mm Mauser, 7 mm-08 Remington, 7 mm Remington Magnum, 7 mm Remington Short Action Ultra Magnum, 7 mm Remington Ultra Magnum, 7×61 mm Sharpe & Hart, 7 mm Shooting Times Westerner, 7 mm Weatherby Magnum, 7 mm Winchester Short Magnum, 7-30 Waters, 7.35×51 mm, 7×33 mm Sako, 7.35×51 mm Carcano, 7.5×54 mm French, 7.5×55 mm Swiss, 7.5×57 mm MAS, 7.62×35 mm, 7.62×39 mm, 7.62×53 mmR, 7.62×54 mmR, 7.62×51 mm NATO, 7.62 Thumper, 7.62×25 mm Tokarev, 7.62×40 Wilson Tactical, 7.62×45 mm vz. 52, 7.63×25 mm Mauser, 7.65×53 mm Argentine, 7.7×58 mm Arisaka, 7.92×33 mm Kurz, 7.92×36 mm EPK, 7.92×57 mm Mauser, 8 mm-06, 8 mm Lebel, 8 mm Remington Magnum, 8×50 mmR Mannlicher, 8×56 mmR, 8×57 mm IS, 8×58 mmR Danish Krag, 8×60 mm S, 8×63 mm patron m/32, 8×64 mm S, 8×68 mm S, 9×39 mm, 9×53 mmR, 9×57 mm Mauser, 9.3×57 mm, 9.3×62 mm, 9.3×64 mm Brenneke, 9.3×74 mmR, 9.5×57 mm Mannlicher-Schoenauer, 10.75×68 mm, 11.15×42R, 11.15×58R, 11×59 mmR Gras, 11×60 mm Mauser, 12.7×54 mm, 12.7×99 mm NATO, 12.7×108 mm, 13.2×92 mm Tank and Flieger, 14.5×114 mm, 14.5 mm JDJ, and 15.2 mm Steyr The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

While this invention has been described in terms of several embodiments, there are alterations, permutations, and equivalents, which fall within the scope of this invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A precision bore guide comprising a main tube, a front stop, a movable stop, and a spring;

said main tube has an inner circumference, outer circumference, a proximal end and a distal end;

said front stop and said movable stop are connected to said main tube; and said front stop is disposed between said proximal end and said moveable stop; and said spring is disposed around said outer circumference of said main tube, and said spring is disposed between said front stop and said movable stop, wherein said proximal end connects to a hollowed-out rifle round, said hollowed-out rifle round comprises a rim end, a casing body, a shoulder and a neck, said rim end connects to said proximal end of said main tube, said casing body is disposed between said rim end and said shoulder, said shoulder disposed between said neck and said casing body.

2. The precision bore guide of claim 1, further comprising a guide bolt knob, said guide bolt knob is connected to said movable stop.

3. The precision bore guide of claim 1, wherein said movable stop comprises a tube having an inner circumference that is larger than said outer circumference of said main tube.

4. The precision bore guide of claim 3, wherein said distal end of said main tube further comprises a flared end having an outer circumference that is larger than said inner circumference of said of said moveable stop.

5. The precision bore guide of claim 1, wherein said front stop comprises a tube having an inner circumference that is larger than said outer circumference of said main tube.

6. The precision bore guide of claim 1, further comprising a rod, said rod having an outer circumference that is smaller than said inner circumference of said main tube.

7. The precision bore guide of claim 1, wherein said proximal end of said main tube further comprises a threaded outer surface.

8. The precision bore guide of claim 1, wherein said rim end of said hollowed-out rifle round further comprises threaded inner surface.

9. The precision bore guide of claim 1, wherein the rifle round of the hollowed-out rifle round is selected from the group of rifle rounds consisting of .17 PMC/Aguila, .17 Hornady Mach 2, 17 Hornady Magnum Rimfire, 17 Winchester Super Magnum, 5 mm Remington Rimfire Magnum, .22 BB Cap, .22 CB Cap, .22 Short, .22 Long, .22 Long Rifle, .22 Extra Long, .22 Remington Automatic, .22 Winchester Automatic, .22 Winchester Rimfire, .22 Winchester Magnum Rimfire, .25 Stevens, .25 Stevens Short, .32 rimfire, .38 rimfire, 10.4×38 mm Swiss Rimfire, .44 Henry, .46 rimfire, .56-46 Spencer, .56-50 Spencer, .56-52 Spencer, .56-56 Spencer, .14-222, .17-223, .17 Ackley Bee, .17 CCM, .17 Hornet, .17 Mach IV, .17 PMC/Aguila, .17 Remington, .17 Remington Fireball, .19-223, .19 Badger, .19 Calhoon Hornet, .20 BR, .20 Tactical, .20 VarTarg, .204 Ruger, .22 Accelerator, .22 Hornet, .22 Cheetah, .218 Bee, .219 Donaldson Wasp, .219 Zipper, .303/22, .22 Savage Hi-Power, .22 BR Remington, .22 Cheetah, .22 Eargesplitten Loudenboomer, .22 PPC, .22 Spitfire, .22 WCF, .220 Russian, .220 Rook, .220 Swift, .221 Remington Fireball, .22 Nosier, .22-250 Remington, .222 Remington, .222 Remington Magnum, .222 Rimmed, .223 Remington, .223 Winchester Super Short Magnum, .224 Weatherby Magnum, .224 Valkyrie, .225 Winchester, .297/230 Morris, .240 Apex, .240 Weatherby Magnum, .242 Rimless Nitro Express, .243 Winchester, .243 Winchester Super Short Magnum, .244 H&H Magnum, .244 Remington, .246 Purdey, .303/25, .25 Remington, .25-45 Sharps, .25-21 Stevens, .25-25 Stevens, .25 Winchester Super Short Magnum, .250 Savage, .25-06 Remington, .25-20 Winchester, .25-35 Winchester, .25-45 Sharps, .297/250 Rook, .250-3000 Savage, .255 Jeffery Rook, .256 Gibbs Magnum, .256 Newton, .256 Winchester Magnum, .257 Roberts, .257 Weatherby Magnum, .26 Nosler, .260 Remington, .264 LBC-AR, .264 Winchester Magnum, .270 Weatherby Magnum, .270 Winchester, .270 Winchester Short Magnum, .275 H&H Magnum, .275 No 2 Magnum, .275 Rigby, .276 Enfield, .276 Pedersen, .277 FURY, .277 Wolverine, .28 Nosler, .280 British, .280 Ross, .280 Flanged, .280 Jeffery, .280 Remington. .280 Ross, .284 Winchester, .30-01, .30-03, .30 Carbine, .30-06 JDJ, .30-40 Krag, .30 Newton, .30 Nosier, .30 R Blaser, .30 Remington, .30 Remington AR, .30-06 Springfield, .303-06, .30 TC, .30-378 Weatherby Magnum, .30-30 Winchester, .300-221, .300 AAC Blackout, .300 H&H Magnum, .300 ICL Grizzly, .300 Lapua Magnum, .300 Norma Magnum, .300 Remington Short Action Ultra Magnum, .300 Remington Ultra Magnum, .300 Rook, .300 Ruger Compact Magnum, .300 Savage, .300 Sherwood, .300 Weatherby Magnum, .300 Whisper, .300 Winchester Magnum, .300 Winchester Short Magnum, .303 British, .303 Magnum, .303 Savage, .375/303 Westley Richards Accelerated Express, .307 Winchester, .308 Marlin Express, .308 Norma Magnum, .308 Winchester, .308×1.5" Barnes, .310 Cadet, .318 Westley Richards, .32 Remington, .32 Winchester Self-Loading, .32 Winchester Special, .32-20 Winchester, .32-40 Ballard, .32-40 Winchester, .325 Winchester Short Magnum, .327 Federal Magnum, .33 Winchester, .333 Jeffery, .338-06 A-Square, .338 Edge, .338 Federal, .338 Lapua Magnum, .33 Nosier, .338 Marlin express, .338 Norma Magnum, .338 Remington Ultra Magnum, .338 Ruger Compact Magnum, .338 Winchester Magnum, .338-378 Weatherby Magnum, .338 Whisper, .340 Weatherby Magnum, .348 Winchester, .35 Winchester Self-Loading, .35 Remington, .35 Whelen, .35 Winchester, .350 Legend, .400/350 Nitro Express, .351 Winchester Self-Loading, .350 Remington Magnum, .350 Rigby, .356 Winchester, .357 Magnum, .358 Norma Magnum, .358 Winchester, .400/360 Nitro Express, .360 No 2 Nitro Express, .360 No 5 Rook, .369 Nitro Express, .375 CheyTac, .375 Dakota, .375 Flanged Nitro Express, .375 H&H Magnum, .375 Remington Ultra Magnum, .375 Ruger, .375 SOCOM, .375 Weatherby Magnum, .375 Whelen, .375 Winchester, .376 Steyr, .378 Weatherby Magnum, .38-40 Winchester, .38-55 Winchester, .38-56 WCF, .380 Long, .40-65 Winchester, .450/400 Black Powder Express, .400 H&H Magnum, .450/400 Nitro Express, .400 Jeffery Nitro Express, .400 Purdey, .400 Whelen, .401 Winchester Self-Loading, .404 Jeffery, .405 Winchester, .408 CheyTac, .416 Barrett, .416 Remington Magnum, .416 Rigby, .416 Ruger, .416 Taylor, .416 Weatherby Magnum, .425 Westley Richards, .44 Henry, .44 Magnum, .44-40 Winchester, .444 Marlin, .45-70 Government, .45-90 Sharps, .45 Raptor, .450 Bushmaster, .577/450 Martini-Henry, .450 Black Powder Express, .500/450 Magnum Black Powder Express, .450 Marlin, .450 Nitro Express, .500/450 No 1 Black Powder Express, .450 No 2 Nitro Express, .454 Casull, .500/450 Nitro Express, .450 Rigby, .450 Watts Magnum, .458×2-inch American, .458 Express, .458 HAM'R, .458 Lott, .458 SOCOM, .458 Winchester Magnum, .460 Steyr, .460 Weatherby Magnum, .461 Gibbs, .465 H&H Magnum, .500/465 Nitro Express, .470 Nitro Express, .475 Nitro Express, .475 No 2 Nitro Express, .476 Nitro Express, .50 Alaskan, .50 Beowulf, .50 BMG, .50-70 Government, .50-90 Sharps, .50-110 Winchester, .50-140 Sharps, .500 A-Square, .500

Black Powder Express, .500 Jeffery, .500 Nitro Express, .577/500 Nitro Express, .577/500 No 2 Black Powder Express, .505 Gibbs, .510 DTC Europ, .510 Whisper, .55 Boys, 20/577 Alexander Henry, .577 Black Powder Express, .577 Nitro Express, .600/577 Rewa, .577 Snider, .577 Tyrannosaur, .585 Nyati, .600 Overkill, .600 Nitro Express, .700 Nitro Express, .950 JDJ, 4.5 mm mkr, 4.6×30 mm, 4.85×49 mm, 5 mm Craig, 5 mm/35 SMc, 5.45×39 mm, 5.56×30 mm MINSAS, 5.56×45 mm NATO, 5.6×50 mm Magnum, 5.6×57 mm, 5.6×57 mmR, 5.6×61 mm VHSE, 5.7×28 mm, 5.8×42 mm, 6×45 mm, 6 mm AR, 6 mm ARC, 6 mm BR Remington, 6 mm Creedmoor, 6 mm Lee Navy, 6 mm Musgrave, 6 mm PPC, 6 mm Remington, 6 mm TCU, 6 mm XC, 6.5-06, 6.5-06 A-Square, 6.5 Creedmoor, 6.5 mm Grendel, 6.5-284 Norma, 6.5 mm Remington Magnum, 6.5 mm TCU, 6.5×47 mm Lapua, 6.5×50 mm Arisaka, 6.5×52 mm Mannlicher-Carcano, 6.5×53 mmR, 6.5×54 mm Mannlicher-Schönauer, 6.5×55 mm Swedish, 6.5×57 mm Mauser, 6.5×58 mm Vergueiro, 6.5×68 mm, 6.5-300 Weatherby Magnum, 6.8 mm Remington SPC, 7×64 mm Brenneke, 7 mm BR Remington, 7×54 mm Finnish, 7×54 mm Fournier, 7×57 mm Mauser, 7 mm-08 Remington, 7 mm Remington Magnum, 7 mm Remington Short Action Ultra Magnum, 7 mm Remington Ultra Magnum, 7×61 mm Sharpe & Hart, 7 mm Shooting Times Westerner, 7 mm Weatherby Magnum, 7 mm Winchester Short Magnum, 7-30 Waters, 7.35×51 mm, 7×33 mm Sako, 7.35×51 mm Carcano, 7.5×54 mm French, 7.5×55 mm Swiss, 7.5×57 mm MAS, 7.62×35 mm, 7.62×39 mm, 7.62×53 mmR, 7.62×54 mmR, 7.62×51 mm NATO, 7.62 Thumper, 7.62×25 mm Tokarev, 7.62×40 Wilson Tactical, 7.62×45 mm vz. 52, 7.63×25 mm Mauser, 7.65×53 mm Argentine, 7.7×58 mm Arisaka, 7.92×33 mm Kurz, 7.92×36 mm EPK, 7.92×57 mm Mauser, 8 mm-06, 8 mm Lebel, 8 mm Remington Magnum, 8×50 mmR Mannlicher, 8×56 mmR, 8×57 mm IS, 8×58 mmR Danish Krag, 8×60 mm S, 8×63 mm patron m/32, 8×64 mm S, 8×68 mm S, 9×39 mm, 9×53 mmR, 9×57 mm Mauser, 9.3×57 mm, 9.3×62 mm, 9.3×64 mm Brenneke, 9.3×74 mmR, 9.5×57 mm Mannlicher-Schoenauer, 10.75×68 mm, 11.15×42R, 11.15×58R, 11×59 mmR Gras, 11×60 mm Mauser, 12.7×54 mm, 12.7×99 mm NATO, 12.7×108 mm, 13.2×92 mm Tank and Flieger, 14.5×114 mm, 14.5 mm JDJ, and 15.2 mm Steyr.

10. A precision bore guide tool comprising a precision bore guide and a hollowed-out rifle round;

said hollowed out rifle round comprising a rim end, a casing body, a shoulder and a neck, said rim end connects to a main tube and said casing body, said casing body is disposed between said rim end and said shoulder, said shoulder disposed between said neck and said casing body;

said precision bore guide comprising a said main tube, a front stop, a movable stop, and a spring;

said main tube has an inner circumference, an outer circumference, a proximal end and a distal end, said proximal end connects to said hollowed-out rifle round; said front stop and said movable stop are connected to said main tube; and said front stop is disposed between said proximal end and said moveable stop; said spring is disposed around said outer circumference of said main tube, and said spring is disposed between said front stop and said movable stop; and said proximal end of said main tube contacts said rim end of said hollowed-out rifle round.

11. The precision bore guide of claim 10, further comprising a guide bolt knob, said guide bolt knob is connected movable stop.

12. The precision bore guide tool of claim 10 wherein said movable stop comprises a tube having an inner circumference that is larger than said outer circumference of said main tube.

13. The precision bore guide tool of claim 12 wherein said distal end of said main tube further comprises a flared end having an outer circumference that is larger than said inner circumference of said inner circumference of said moveable stop.

14. The precision bore guide tool of claim 10 wherein said front stop comprises a tube having an inner circumference that is larger than said outer circumference of said main tube.

15. The precision bore guide tool of claim 10 wherein said proximal end of said main tube further comprises a threaded outer surface.

16. The precision bore guide tool of claim 1 wherein said rim end of said hollowed-out rifle round further comprises threaded inner surface.

17. The precision bore guide tool of claim 10, further comprising a rod, said rod having an outer circumference that is smaller than the inner circumference of said main tube.

18. The precision bore guide tool of claim 10, wherein the rifle round of the hollowed-out rifle round is selected from the group of rifle rounds consisting of .17 PMC/Aguila, .17 Hornady Mach 2, 17 Hornady Magnum Rimfire, 17 Winchester Super Magnum, 5 mm Remington Rimfire Magnum, .22 BB Cap, .22 CB Cap, .22 Short, .22 Long, .22 Long Rifle, .22 Extra Long, .22 Remington Automatic, .22 Winchester Automatic, .22 Winchester Rimfire, .22 Winchester Magnum Rimfire, .25 Stevens, .25 Stevens Short, .32 rimfire, .38 rimfire, 10.4×38 mm Swiss Rimfire, .44 Henry, .46 rimfire, .56-46 Spencer, .56-50 Spencer, .56-52 Spencer, .56-56 Spencer, .14-222, .17-223, .17 Ackley Bee, .17 CCM, .17 Hornet, .17 Mach IV, .17 PMC/Aguila, .17 Remington, .17 Remington Fireball, .19-223, .19 Badger, .19 Calhoon Hornet, .20 BR, .20 Tactical, .20 VarTarg, .204 Ruger, .22 Accelerator, .22 Hornet, .22 Cheetah, .218 Bee, .219 Donaldson Wasp, .219 Zipper, .303/22, .22 Savage Hi-Power, .22 BR Remington, .22 Cheetah, .22 Eargesplitten Loudenboomer, .22 PPC, .22 Spitfire, .22 WCF, .220 Russian, .220 Rook, .220 Swift, .221 Remington Fireball, .22 Nosier, .22-250 Remington, .222 Remington, .222 Remington Magnum, .222 Rimmed, .223 Remington, .223 Winchester Super Short Magnum, .224 Weatherby Magnum, .224 Valkyrie, .225 Winchester, .297/230 Morris, .240 Apex, .240 Weatherby Magnum, .242 Rimless Nitro Express, .243 Winchester, .243 Winchester Super Short Magnum, .244 H&H Magnum, .244 Remington, .246 Purdey, .303/25, .25 Remington, .25-45 Sharps, .25-21 Stevens, .25-25 Stevens, .25 Winchester Super Short Magnum, .250 Savage, .25-06 Remington, .25-20 Winchester, .25-35 Winchester, .25-45 Sharps, .297/250 Rook, .250-3000 Savage, .255 Jeffery Rook, .256 Gibbs Magnum, .256 Newton, .256 Winchester Magnum, .257 Roberts, .257 Weatherby Magnum, .26 Nosler, .260 Remington, .264 LBC-AR, .264 Winchester Magnum, .270 Weatherby Magnum, .270 Winchester, .270 Winchester Short Magnum, .275 H&H Magnum, .275 No 2 Magnum, .275 Rigby, .276 Enfield, .276 Pedersen, .277 FURY, .277 Wolverine, .28 Nosler, .280 British, .280 Ross, .280 Flanged, .280 Jeffery, .280 Remington. .280 Ross, .284 Winchester, .30-01, .30-03, .30 Carbine, .30-06 JDJ, .30-40 Krag, .30 Newton, .30 Nosier, .30 R Blaser, .30 Remington, .30 Remington AR, .30-06 Springfield, .303-06, .30 TC, .30-378 Weatherby Magnum, .30-30 Winchester, .300-221, .300 AAC Blackout, .300 H&H Magnum, .300 ICL Grizzly, .300 Lapua Magnum, .300 Norma Magnum, .300 Remington Short Action Ultra Magnum, .300 Remington Ultra Magnum, .300 Rook, .300 Ruger Compact Magnum, .300 Savage, .300 Sherwood, .300 Weatherby Magnum, .300 Whisper, .300 Winchester Magnum, .300 Winchester Short Magnum, .303 British, .303 Magnum, .303 Savage, .375/303 Westley Richards Accelerated Express, .307 Winchester, .308 Marlin Express, .308 Norma Magnum, .308 Winchester, .308×1.5" Barnes, .310 Cadet, .318 Westley Richards, .32 Remington, .32 Winchester Self-Loading, .32 Winchester Special, .32-20 Winchester, .32-40 Ballard, .32-40 Winchester, .325 Winchester Short Magnum, .327 Federal Magnum, .33 Winchester, .333 Jeffery, .338-06 A-Square, .338 Edge, .338 Federal, .338 Lapua Magnum, .33 Nosier, .338 Marlin express, .338 Norma Magnum, .338 Remington Ultra Magnum, .338 Ruger Compact Magnum, .338 Winchester Magnum, .338-378 Weatherby Magnum, .338 Whisper, .340 Weatherby Magnum, .348 Winchester, .35 Winchester Self-Loading, .35 Remington, .35 Whelen, .35 Winchester, .350 Legend, .400/350 Nitro Express, .351 Winchester Self-Loading, .350 Remington Magnum, .350 Rigby, .356 Winchester, .357 Magnum, .358 Norma Magnum, .358 Winchester, .400/360 Nitro Express, .360 No 2 Nitro Express, .360 No 5 Rook, .369 Nitro Express, .375 CheyTac, .375 Dakota, .375 Flanged Nitro Express, .375 H&H Magnum, .375 Remington Ultra Magnum, .375 Ruger, .375 SOCOM, .375 Weatherby Magnum, .375 Whelen, .375 Winchester, .376 Steyr, .378 Weatherby Magnum, .38-40 Winchester, .38-55 Winchester, .38-56 WCF, .380 Long, .40-65 Winchester, .450/400 Black Powder Express, .400 H&H Magnum, .450/400 Nitro Express, .400 Jeffery Nitro Express, .400 Purdey, .400 Whelen, .401 Winchester Self-Loading, .404 Jeffery, .405 Winchester, .408 CheyTac, .416 Barrett, .416 Remington Magnum, .416 Rigby, .416 Ruger, .416 Taylor, .416 Weatherby Magnum, .425 Westley Richards, .44 Henry, .44 Magnum, .44-40 Winchester, .444 Marlin, .45-70 Government, .45-90 Sharps, .45 Raptor, .450 Bushmaster, .577/450 Martini-Henry, .450 Black Powder Express, .500/450 Magnum Black Powder Express, .450 Marlin, .450 Nitro Express, .500/450 No 1 Black Powder Express, .450 No 2 Nitro Express, .454 Casull, .500/450 Nitro Express, .450 Rigby, .450 Watts Magnum, .458×2-inch American, .458 Express, .458 HAM'R, .458 Lott, .458 SOCOM, .458 Winchester Magnum, .460 Steyr, .460 Weatherby Magnum, .461 Gibbs, .465 H&H Magnum, .500/465 Nitro Express, .470 Nitro Express, .475 Nitro Express, .475 No 2 Nitro Express, .476 Nitro Express, .50 Alaskan, .50 Beowulf, .50 BMG, .50-70 Government, .50-90 Sharps, .50-110 Winchester, .50-140 Sharps, .500 A-Square, .500 Black Powder Express, .500 Jeffery, .500 Nitro Express, .577/500 Nitro Express, .577/500 No 2 Black Powder Express, .505 Gibbs, .510 DTC Europ, .510 Whisper, .55 Boys, 20/577 Alexander Henry, .577 Black Powder Express, .577 Nitro Express, .600/577 Rewa, .577 Snider, .577 Tyrannosaur, .585 Nyati, .600 Overkill, .600 Nitro Express, .700 Nitro Express, .950 JDJ, 4.5 mm mkr, 4.6×30 mm, 4.85×49 mm, 5 mm Craig, 5 mm/35 SMc, 5.45×39 mm, 5.56×30 mm MINSAS, 5.56×45 mm NATO, 5.6×50 mm Magnum, 5.6×57 mm, 5.6×57 mmR, 5.6×61 mm VHSE, 5.7×28 mm, 5.8×42 mm, 6×45 mm, 6 mm AR, 6 mm ARC, 6 mm BR Remington, 6 mm Creedmoor, 6 mm Lee Navy, 6 mm Musgrave, 6 mm PPC, 6 mm Remington, 6 mm TCU, 6 mm XC, 6.5-06, 6.5-06 A-Square, 6.5 Creedmoor, 6.5 mm Grendel, 6.5-284 Norma, 6.5 mm Remington Magnum, 6.5 mm TCU, 6.5×47 mm Lapua, 6.5×50 mm Arisaka, 6.5×52 mm Mannlicher-Carcano, 6.5×53 mmR, 6.5×54 mm Mannlicher-Schönauer, 6.5×55 mm Swedish, 6.5×57 mm Mauser, 6.5×58 mm Vergueiro, 6.5×68 mm, 6.5-300 Weatherby Magnum, 6.8 mm Remington SPC, 7×64 mm Brenneke, 7 mm BR Remington, 7×54 mm Finnish, 7×54 mm Fournier, 7×57 mm Mauser, 7 mm-08 Remington, 7 mm Remington Magnum, 7 mm Remington Short Action Ultra Magnum, 7 mm Remington Ultra Magnum, 7×61 mm Sharpe & Hart, 7 mm Shooting Times Westerner, 7 mm Weatherby Magnum, 7 mm Winchester Short Magnum, 7-30 Waters, 7.35×51 mm, 7×33 mm Sako, 7.35×51 mm Carcano, 7.5×54 mm French, 7.5×55 mm Swiss, 7.5×57 mm MAS, 7.62×35 mm, 7.62×39 mm, 7.62×53 mmR, 7.62×54 mmR, 7.62×51 mm NATO, 7.62 Thumper, 7.62×25 mm Tokarev, 7.62×40 Wilson Tactical, 7.62×45 mm vz. 52, 7.63×25 mm Mauser, 7.65×53 mm Argentine, 7.7×58 mm Arisaka, 7.92×33 mm Kurz, 7.92×36 mm EPK, 7.92×57 mm Mauser, 8 mm-06, 8 mm Lebel, 8 mm Remington Magnum, 8×50 mmR Mannlicher, 8×56 mmR, 8×57 mm IS, 8×58 mmR Danish Krag, 8×60 mm S, 8×63 mm patron m/32, 8×64 mm S, 8×68 mm S, 9×39 mm, 9×53 mmR, 9×57 mm Mauser, 9.3×57 mm, 9.3×62 mm, 9.3×64 mm Brenneke, 9.3×74 mmR, 9.5×57 mm Mannlicher-Schoenauer, 10.75×68 mm, 11.15×42R, 11.15×58R, 11×59 mmR Gras, 11×60 mm Mauser, 12.7×54 mm, 12.7×99 mm NATO, 12.7×108 mm, 13.2×92 mm Tank and Flieger, 14.5×114 mm, 14.5 mm JDJ, and 15.2 mm Steyr.

* * * * *